US008347573B2

(12) United States Patent
Stanhope

(10) Patent No.: US 8,347,573 B2
(45) Date of Patent: Jan. 8, 2013

(54) WOOD BOARD INCORPORATING EMBEDDED SOUND ATTENUATING ELEMENTS AND STIFFENING ELEMENTS

(76) Inventor: Thomas Spencer Stanhope, St. Albans, VT (US)

( * ) Notice: Subject to any disclaimer, the term of this patent is extended or adjusted under 35 U.S.C. 154(b) by 0 days.

(21) Appl. No.: 12/221,104

(22) Filed: Jul. 31, 2008

(65) Prior Publication Data

US 2010/0024334 A1 Feb. 4, 2010

(51) Int. Cl.

| | |
|---|---|
| ***E04B 1/82*** | (2006.01) |
| ***E04B 1/74*** | (2006.01) |
| ***E04B 2/00*** | (2006.01) |
| ***E04C 1/00*** | (2006.01) |
| ***E04C 2/34*** | (2006.01) |

(52) U.S. Cl. ..... 52/309.9; 52/144; 52/404.3; 52/592.1; 52/794.1

(58) Field of Classification Search ..... 52/144, 52/145, 309.8, 309.9, 309.15, 404.3, 588.1, 52/589.1, 592.1, 783.1, 783.11, 790.1, 793.1, 52/794.1, 783.18, 783.14, 787.11, 793.11, 52/592.4, 480, 506.07, 309.16

See application file for complete search history.

(56) References Cited

U.S. PATENT DOCUMENTS

| | | | | | |
|---|---|---|---|---|---|
| 593,804 | A | * | 11/1897 | Hintze | 52/22 |
| 1,923,195 | A | * | 8/1933 | Finck | 52/404.3 |
| 1,928,034 | A | * | 9/1933 | Schulstadt | 428/49 |
| 2,007,130 | A | * | 7/1935 | Munroe et al. | 181/285 |
| 2,069,755 | A | | 2/1937 | Foster | |
| 2,070,479 | A | | 2/1937 | Foster | |
| 2,101,568 | A | * | 12/1937 | Woodbury | 428/157 |
| 2,140,210 | A | * | 12/1938 | Schenk | 181/291 |
| 2,528,049 | A | * | 10/1950 | Gonda | 181/292 |
| 3,260,027 | A | * | 7/1966 | Page et al. | 52/602 |
| 3,305,986 | A | * | 2/1967 | Mathews | 52/270 |
| 3,472,728 | A | * | 10/1969 | Hitch | 428/119 |
| 4,154,030 | A | * | 5/1979 | Huguet | 52/98 |
| 4,685,259 | A | | 8/1987 | Eberhart et al. | |
| 4,860,506 | A | * | 8/1989 | Yoshimi et al. | 52/144 |
| 5,009,043 | A | * | 4/1991 | Kurrasch | 52/145 |
| 5,119,593 | A | * | 6/1992 | Bae | 49/501 |
| 5,309,690 | A | * | 5/1994 | Symons | 52/309.9 |
| 5,497,595 | A | * | 3/1996 | Kalinin | 52/836 |
| 5,879,781 | A | * | 3/1999 | Mehta et al. | 428/137 |
| 6,182,413 | B1 | * | 2/2001 | Magnusson | 52/589.1 |
| 6,772,572 | B2 | * | 8/2004 | Henthorn | 52/847 |
| 6,869,669 | B2 | * | 3/2005 | Jensen et al. | 428/294.7 |
| 6,945,414 | B1 | * | 9/2005 | Stevens et al. | 211/94.01 |
| 7,117,650 | B2 | * | 10/2006 | Dockery | 52/506.07 |
| 7,603,824 | B1 | * | 10/2009 | Hartanto | 52/384 |
| 7,854,098 | B2 | * | 12/2010 | Stanhope | 52/309.3 |
| 2003/0024640 | A1 | * | 2/2003 | Hill | 156/331.4 |
| 2005/0208255 | A1 | * | 9/2005 | Pervan | 428/60 |
| 2005/0252126 | A1 | * | 11/2005 | Chan | 52/309.9 |
| 2006/0207203 | A1 | * | 9/2006 | Kennedy | 52/404.3 |
| 2006/0230699 | A1 | | 10/2006 | Keene | |
| 2006/0248845 | A1 | * | 11/2006 | Hubbard | 52/716.1 |
| 2007/0094950 | A1 | | 5/2007 | Surace et al. | |

(Continued)

*Primary Examiner* — Joshua J Michener
*Assistant Examiner* — Ryan Kwiecinski
(74) *Attorney, Agent, or Firm* — Thomas G. Ference

(57) ABSTRACT

A board comprised of a wood structure having a first surface, a second surface, a first lateral edge, a second lateral edge and opposing ends. Sound attenuating elements embedded within the wood structure and stiffening elements positioned within the wood structure to coincide with the location of floor joist to which the board will be secured. The boards further forming a ceiling/floor structure by laying a single set of the boards adjacent to each other and securing them to the floor joists.

4 Claims, 10 Drawing Sheets

U.S. PATENT DOCUMENTS

2007/0137139 A1 6/2007 Tierney et al.
2007/0175173 A1* 8/2007 Babineau et al. ..... 52/745.05
2008/0289901 A1* 11/2008 Coury ..... 181/286
2009/0044484 A1* 2/2009 Berger ..... 52/783.1
2009/0185366 A1* 7/2009 Beaulieu ..... 362/133
2010/0266792 A1* 10/2010 Pfistner et al. ..... 428/35.6

* cited by examiner

Or

WOOD BOARD INCORPORATING EMBEDDED SOUND ATTENUATING ELEMENTS AND STIFFENING ELEMENTS

FIELD OF THE INVENTION

This invention relates generally to boards used in the installation of flooring and ceiling. In particular, the present invention is directed to a board that incorporates embedded sound attenuating elements and stiffening elements to create a sound resistant floor and ceiling structure using only one layer of the boards.

BACKGROUND OF THE INVENTION

The log cabin and post and beam building industry traditionally matches the ceiling materials to that of the softwood walls of the room. Tongue and groove softwood boards are laid across the post and beam structure. The softwood-ceiling boards typically have a chamfer on each edge to help aesthetically offset any minor variations where the boards meet. If the boards are for a first level ceiling, they may also act as the flooring for the second level of rooms if they have sufficient thickness. However, many homeowners would prefer a hardwood floor as it is more durable than softwood and the hardwood can add an aesthetically appealing visual offset to all of the surrounding softwood making up the walls and ceiling. Currently to install a hardwood floor in a post and beam building requires that the builder lay down a second layer of flooring made of hardwood on top of the softwood flooring already in place for the lower level ceiling. Laying down a second layer of flooring made of hardwood adds considerably to materials cost and labor. These costs may be more than fifty percent of the overall flooring/ceiling costs. Furthermore, sound transmission between the first and second levels of a building is a concern. Solid wood boards do not offer a high level of sound resistance with respect to both impact and airborne sounds. To mitigate this problem a sound attenuating layer is usually placed between the ceiling boards and the floor boards. This additional step of incorporating a sound attenuating layer further increases the overall cost of installing the flooring/ceiling system. The prior art offers no simple and cost effective alternatives to this multi-step process for creating a sound resistant hardwood-floor/softwood-ceiling between two levels of a building.

SUMMARY OF THE INVENTION

One aspect of the present invention is directed to a board comprising a wood structure having a first surface, a second surface, a first lateral edge, a second lateral edge and opposing ends. Sound attenuating elements are embedded within the wood structure. Stiffening elements are positioned within the wood structure to coincide with the location of floor joists to which the board will be secured.

Another aspect is directed to a method of fabricating a board comprising the steps of providing a first wood layer having a first wood surface, a second wood surface, a first wood lateral edge, a second wood lateral edge and opposing wood ends. Milling the first wood layer to create hollow regions and then embedding sound attenuating elements in the hollow regions.

Still another aspect is directed to a method of fabricating a board comprising the steps of providing a first wood layer having a first wood surface, a second wood layer having a second wood surface, sound attenuating elements and stiffening elements. The method includes coating a portion of the sound attenuating elements and stiffening elements with adhesive and laying a matrix of the adhesively coated sound attenuating elements and stiffening elements on the first surface of the first wood layer. The method further includes positioning the second wood layer on top of the matrix and bonding the first wood layer, stiffening elements, the sound attenuating elements and the second wood layer together to form the board.

Yet another aspect is directed to a structure comprising a ceiling/floor formed from floor joists and a single set of adjacent boards. Each of the adjacent boards includes embedded sound attenuating elements and stiffening elements, wherein the stiffening elements are positioned to coincide with the location of the floor joist to which the board is secured.

Still yet another aspect is directed to a method of fabricating a ceiling/floor comprising the steps of providing floor joists and a set of boards. Each board includes embedded sound attenuating elements and stiffening elements that are positioned to coincide with the location of the floor joists. The method then includes laying the set of boards adjacent to each other on the floor joists and securing the stiffening elements of each board to the floor joist as each board is laid.

BRIEF DESCRIPTION OF DRAWINGS

The foregoing and other aspects and advantages of the invention will be apparent from the following detailed description of the invention, as illustrated in the accompanying drawings, in which.

DETAILED DESCRIPTION OF THE INVENTION

Figure 1:
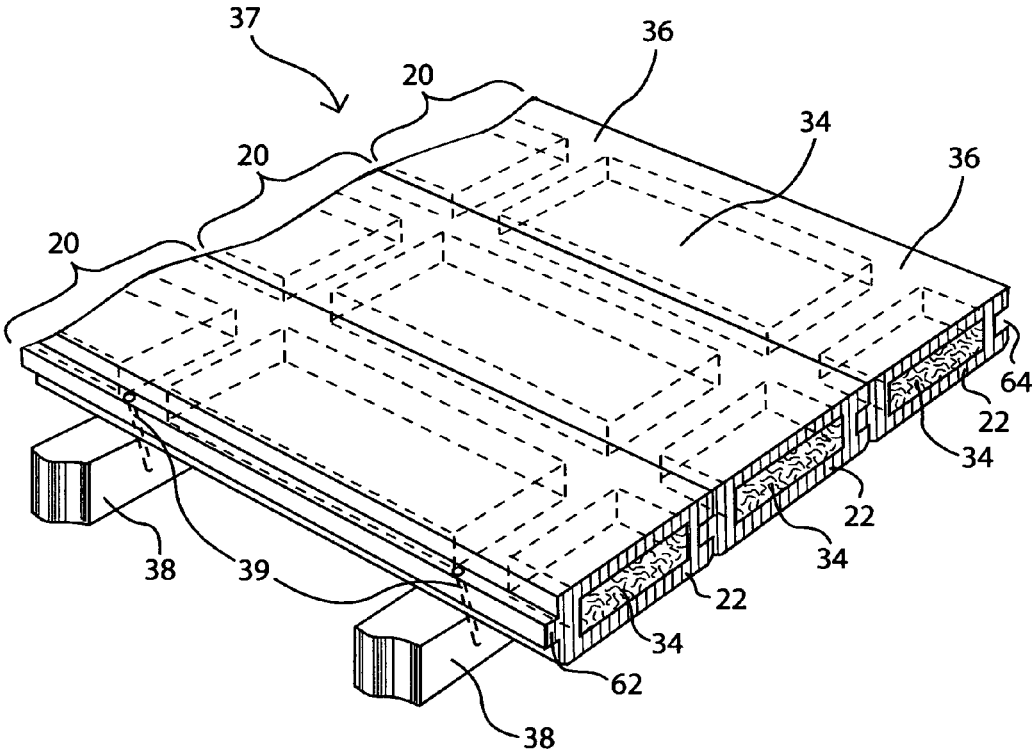
FIG. 1 is a perspective view of a ceiling/floor structure in accordance with the present invention showing boards incorporating embedded sound attenuating elements and stiffening elements, the stiffening elements are positioned to coincide with the location of floor joist to which the boards are secured.
Figure 2A:
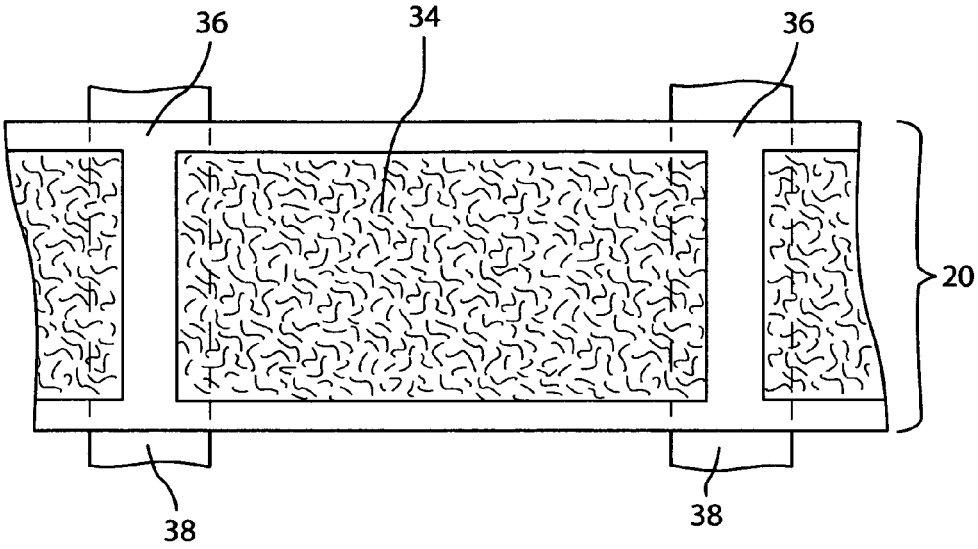
FIG. 2*a* is a sectional, plan view of a board according to this inventions showing sound attenuating elements and stiffening elements, and their relationship to the floor joists.
Figure 2B:
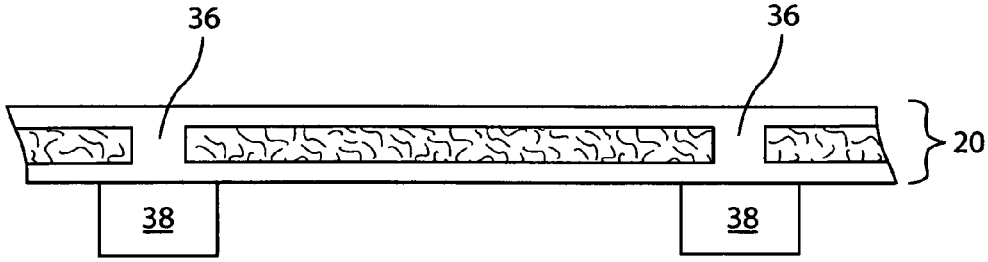
FIG. 2*b* is a sectional, side view of the board in FIG. 2*a* showing sound attenuating elements and stiffening elements, and their relationship to the floor joists.
Figure 3:
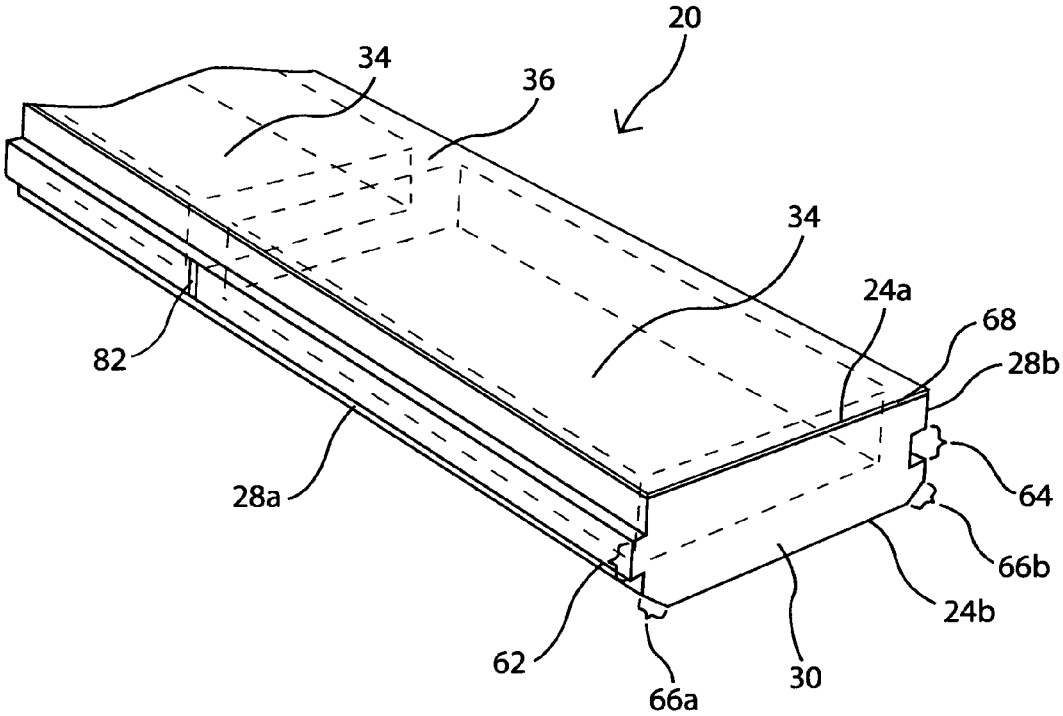
FIG. 3 is a perspective view of a single board showing embedded sound attenuating elements, stiffening elements, tongue, groove and chamfers.
Figure 4A:
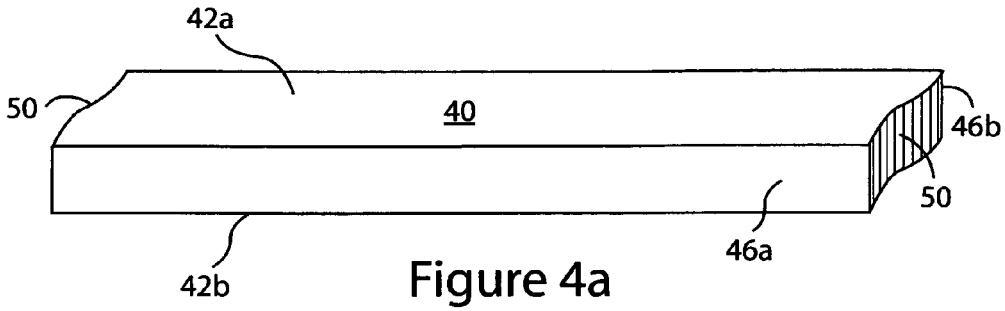
FIG. 4*a* is a first wood layer used in a first method of fabricating a board in accordance with the present invention.
Figure 4B:
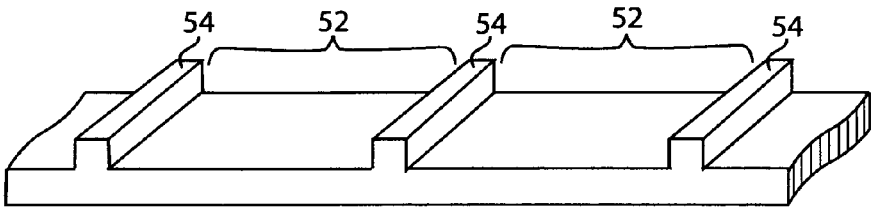
FIG. 4*b* is the first wood layer in FIG. 4*a* now milled from a first wood surface to create hollow regions and stiffening elements.
Figure 4C:
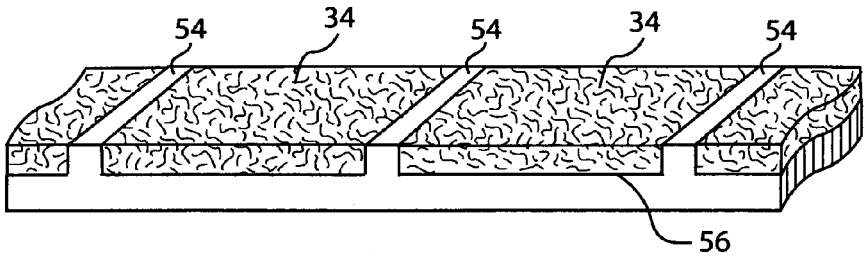
FIG. 4*c* is the first wood layer in FIG. 4*b* now having the hollow regions filled with sound attenuating elements.
Figure 4D:
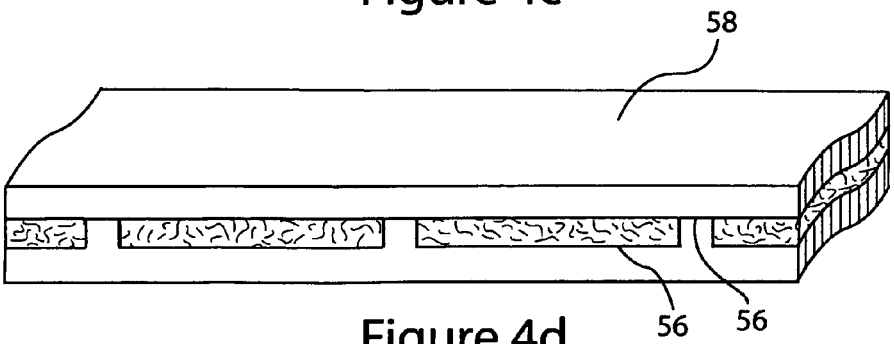
FIG. 4*d* is the first wood layer in FIG. 4*c* now having a second wood layer bonded to the first wood layer.

FIGS. 1-9 illustrates board 20 according to the present invention. Board 20 can be in the range of 2-12 inches wide and 2-20 feet long, but is typically about 6-inches wide and 8-feet long. Board 20 comprises a wood structure 22 having first surface 24*a*, second surface 24*b*, first lateral edge 28*a*, second lateral edge 28*b* and opposing ends 30. Sound attenuating elements 34 are embedded within wood structure 22. Each sound attenuating element 34 has a first side 59 and a second side 61. Sound attenuating element 34 may be any sound attenuating material, but preferably a material such as CELOTEX® fiber board or foam such as SPRAYFOAM®. Both of these materials provide structural rigidity yet have high sound attenuation qualities. However, because the structural rigidity of these sound attenuating materials is not as good as that of natural wood, stiffening elements 36 are added to the board 20 to help strengthen the board. Stiffening elements 36 are positioned within wood structure 22 to coincide with the location of floor joists 38 to which the board 20 will be secured. Typically, the floor joists 38 are spaced at 24-inches, 32-inches or 48-inches. Stiffening elements 36 are preferably natural wood, but could be a high-strength wood composite or other high-strength material. Together sound attenuating elements 34 and stiffening elements 36 make up a matrix within board 20. Sound attenuation elements 34 are preferably a continuous layer of sound attenuating material that spans between stiffening elements 36. When embedded within wood structure 22, sound attenuating elements 34 are a solid sound attenuating material. Stiffening elements 36 provide strength to board 20 so that the board is less likely to flex under an applied load as well as provide stiff regions that can be secured to floor joists 38. Stiffening elements 36 may take on any shape and orientation within the matrix so long as they coincide with floor joists 38. The location where stiffening elements 36 and floor joists 38 coincide is where securing elements 39 such as nails, screws, etc. secure board 20 to the floor joists. FIG. 1 illustrates ceiling/floor structure 37 where adjacent boards 20 are secured by securing elements 39 to floor joist 38.

Several methods may be used to manufacture board 20 as illustrated in FIGS. 4-8. A first method is illustrated in FIGS. 4*a-d*. In this first method a first wood layer 40 is provided as illustrated in FIG. 4*a*. First wood layer 40 has a first wood surface 42*a*, a second wood surface 42*b*, a first wood lateral edge 46*a*, a second wood lateral edge 46*b*, and opposing wood ends 50. First wood layer 40 can be a single piece of lumber or a single piece of graded, finger-jointed lumber. First wood layer 40 is milled from the first wood surface 42*a* to create hollow regions 52 in the first wood layer. During this milling step, stiffening elements 36 are created as un-milled regions of the first wood layer 40 that coincide with the location of floor joists 38 to which board 20 will be secured. In FIG. 4*b* stiffening elements 36 are shown as transverse stiffening elements 54. Transverse stiffening elements 54 lay across board 20 substantially perpendicular to both first and second wood lateral edges, 46*a* and 46*b*, respectively. Transverse stiffening elements 54 are substantially the same width as floor joist 38 and when used in constructing a floor/ceiling structure coincide with the floor joist and lay substantially parallel to the floor joist. First wood layer 40, however, can be milled to have stiffening elements 36 that differ in orientation and shape from the transverse stiffening elements 54. In general stiffening elements 36 will coincide with floor joists 38 providing added rigidity to board 20 as well as stiff sections through which to secure the board to the floor joists. Hollow regions 52 are then embedded with sound attenuating elements 34 as illustrated in FIG. 4*c*. Sound attenuating elements 34 may be fibers, foam or other sound attenuating layer that has been cut to size. Sound attenuating elements 34 are coated on one or more surfaces with an adhesive layer 56 and placed within hollow region 52. A second wood layer 58 is then bonded to first wood layer 40 on first wood surface 42*a* with adhesive layer 56 as illustrated in FIG. 4*d*. Second wood layer 58 can be a single piece of lumber or a single piece of graded, finger-jointed lumber. Adhesive layer 56 is applied as needed to any surface of the wood layers or sound attenuating elements 34 to be joined. Adhesive layer 56 may be rolled or sprayed onto each layer. First wood layer 40 and second wood layer 58, with embedded sound attenuating elements 34 between them, is then press rolled or clamp pressed to create wood structure 22 incorporating the sound attenuating elements and stiffening elements 36. Heating by radiation or RF heating may or may not be added into the process depending on the type of adhesive used. Adhesive layer 56 may be glue, an epoxy or other similar wood-bonding agent. Examples of commercially available wood bonding adhesives are TITEBOND®-50 and TITEBOND®-Regular, both aliphatic resin emulsion adhesives manufactured by Franklin Adhesives. All wood in wood structure 22 is preferably kiln dried to 6-8% moisture. Having low moisture content helps reduce warping in board 20.

For the method defined in FIGS. 4*a-d*, first wood layer 40 and second wood layer 58 may both be the same species of wood or different species of wood. For example in a hardwood-floor/softwood-ceiling board, first wood layer 40 is preferably softwood and second wood layer 58 is preferably hardwood. Softwoods include species such as pine, spruce, fir, white cedar, red cedar and any other domestic or imported softwood. Hardwoods include species such as oak, maple, birch, ash, walnut, hickory, cherry, and any other domestic or imported hardwood. When first wood layer 40 and second wood layer 58 are single layers of natural wood, each is a saw cut layer rather than rotary peeled from the circumference of the log which is known as veneer fashion. Rotary peeled layers inherently have fractures from the peeling process making them undesirable for use in boards 20.

Figure 5A:
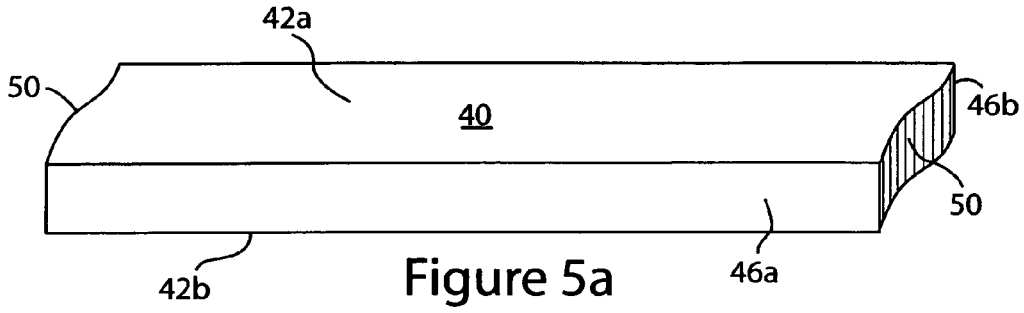
FIG. 5*a* is a first wood layer used in a second method of fabricating a board in accordance with the present invention.
Figure 5B:
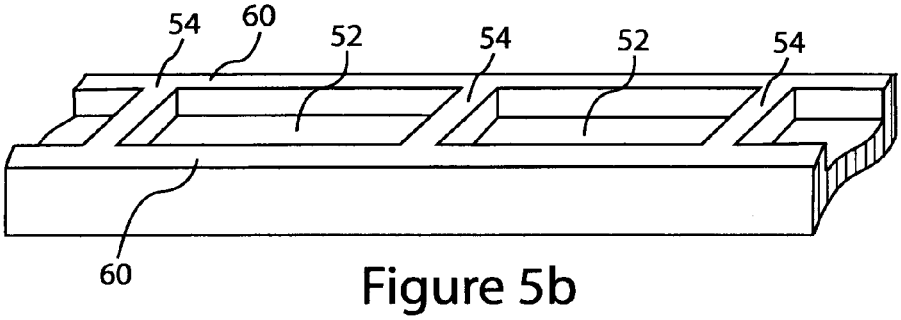
FIG. 5*b* is the first wood layer in FIG. 5*a* now milled to create hollow regions, transverse stiffening elements and lateral stiffening elements.
Figure 5C:
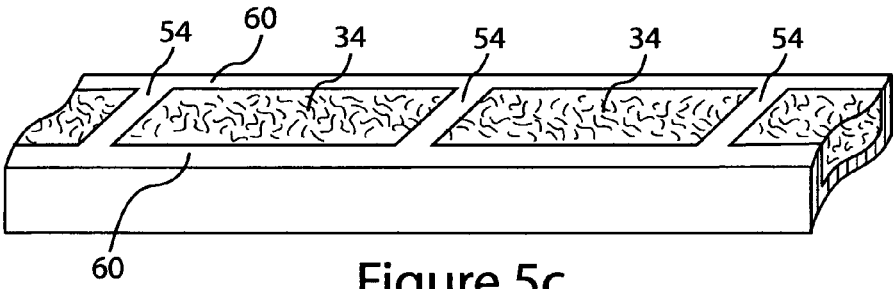
FIG. 5*c* is the first wood layer in FIG. 5*b* now having the hollow regions filled with sound attenuating elements.
Figure 5D:
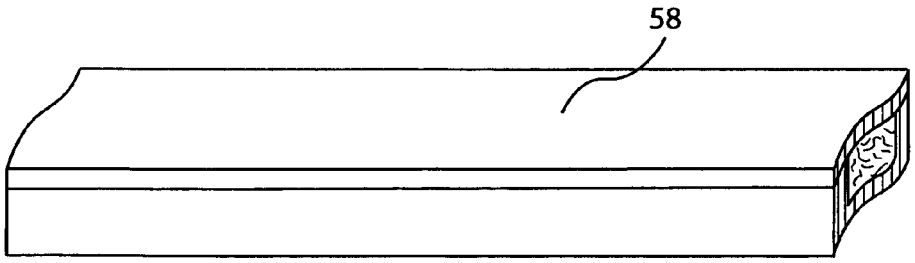
FIG. 5*d* is the first wood layer in FIG. 5*c* now having a second wood layer bonded to the first wood layer.

FIGS. 5*a-d* illustrate a second method of fabricating board 20 according to the present invention. In this second method the steps are the same as described in the first method above (FIG. 4*a-d*) except that during the milling step illustrated in FIG. 4*b*, the milling is now modified to produce a structure that has both transverse stiffening elements 54 and lateral stiffening elements 60 as illustrated in FIG. 5*b*. Lateral stiffening elements 60 lay along the first wood lateral edge 46*a* and second wood lateral edge 46*b* of first wood layer 40. Lateral stiffening elements 60 provide further strength and stiffening to board 20 as well as provide for a wood surface on all edges of the board. As shown in FIG. 5*c*, hollow regions 52 are once again filled with appropriately sized sound attenuating elements 34 in the same manner as in the first method. Then in FIG. 5*d*, second wood layer 58 (either of the same wood species or different wood species) is bonded to first wood layer 40 on first wood surface 42*a* with adhesive layer 56, again the same manner of bonding is used as in the first method.

Figure 6A:
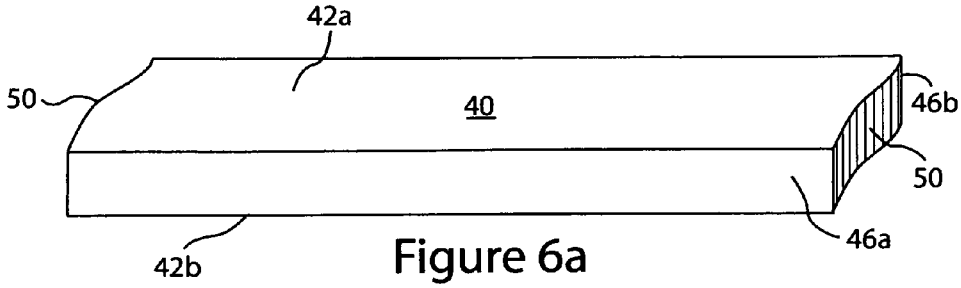
FIG. 6*a* is a first wood layer used in a third method of fabricating a board in accordance with the present invention.
Figure 6B:
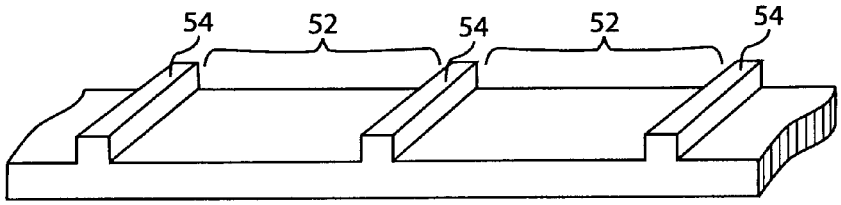
FIG. 6*b* is the first wood layer in FIG. 6*a* now milled to create hollow regions and transverse stiffening elements.
Figure 6C:
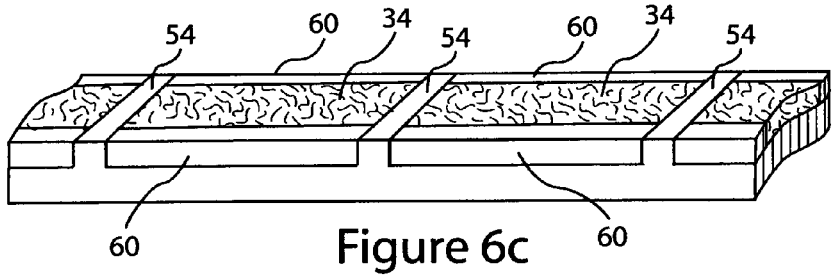
FIG. 6*c* is the first wood layer in FIG. 6*b* now having the hollow regions filled with sound attenuating elements and lateral stiffening elements.
Figure 6D:
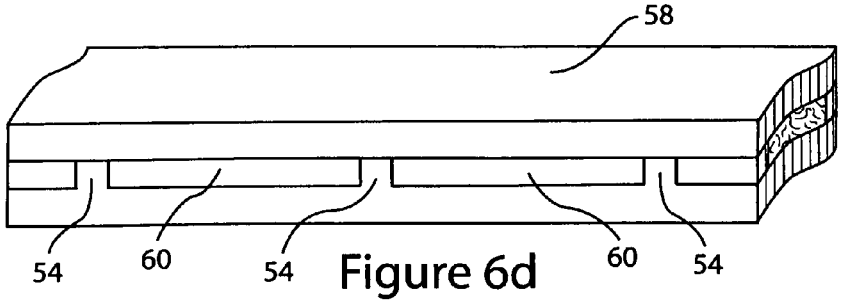
FIG. 6*d* is the first wood layer in FIG. 6*c* now having a second wood layer bonded to the first wood layer.

FIGS. 6*a-d* illustrate a third method of fabricating board 20 according to the present invention. In this third method the steps are the same as described in the first method above (FIG. 4*a-d*) except that during the embedding step illustrated in FIG. 4*c*, hollow regions 52 are now filled with sound attenuating elements 34 on the interior and pieces of wood along the first wood lateral edge 46*a* and second wood lateral edge 46*b* as illustrated in FIG. 6*c*. These pieces of wood become lateral stiffening elements 60. Again, an adhesive layer 56 is applied on each appropriate surface of either the sound attenuating elements 34 or lateral stiffening elements 60. Then in FIG. 6*d*, second wood layer 58 (either of the same wood species or different wood species) is bonded to first wood layer 40 on first wood surface 42*a* with adhesive layer 56, again the same manner of bonding is used as in the first method.

Figure 7A:
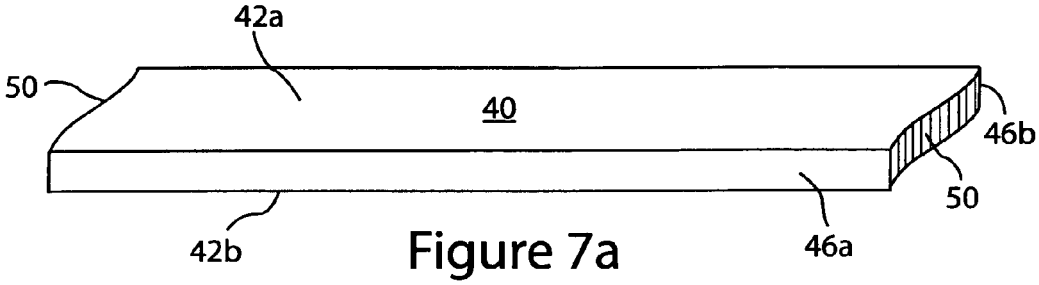
FIG. 7*a* is a first wood layer used in a fourth method of fabricating a board in accordance with the present invention.
Figure 7B:
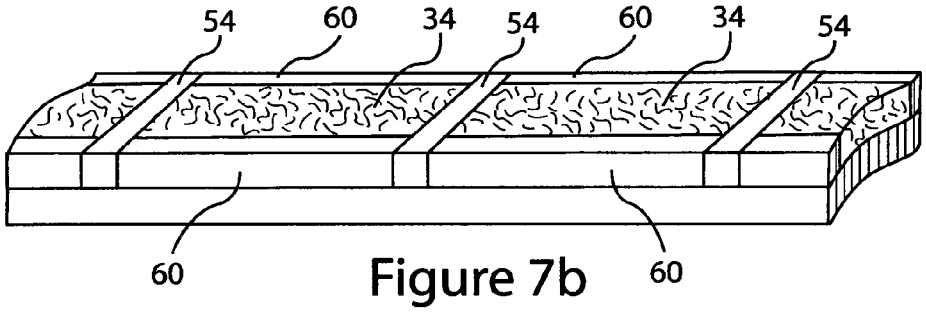
FIG. 7*b* shows a matrix of stiffening elements and sound attenuating elements laid upon the first wood layer in FIG. 7*a;*
Figure 7C:
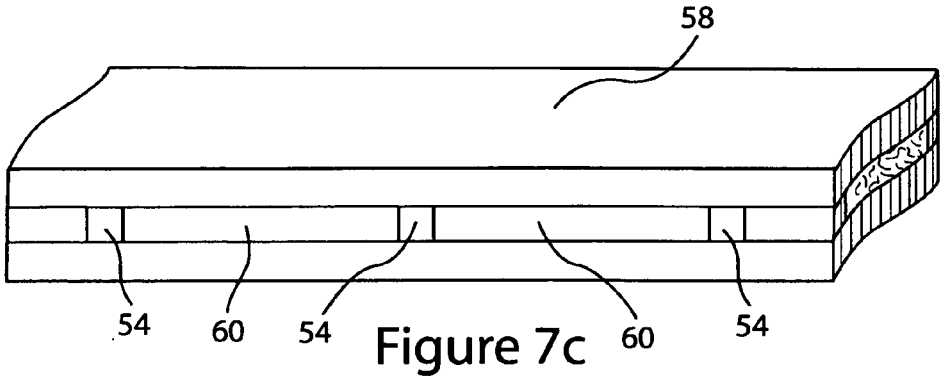
FIG. 7*c* shows a second wood layer bonded to the matrix in FIG. 7*b;*

FIGS. 7*a-c* illustrate a fourth method of fabricating board 20 according to the present invention. In this fourth method a first wood layer 40 is provided as in the first method described above. However, instead of milling the first wood layer, separate sound attenuating elements 34 and stiffening elements (being at least one from the group including transverse stiffening elements 54 and lateral stiffening elements 60) are laid on first wood surface 42*a* of first wood layer 40 to form a matrix as illustrated in FIG. 7*b*. The matrix may be any combination of sound attenuating elements 34 and stiffening elements 36. Each element of the matrix is appropriately coated with a layer of adhesive. During this laying step, stiffening elements are positioned to coincide with floor 38 joists to which board 20 will be secured. A second wood layer 58, either of the same species or different species of wood, is positioned on top of the matrix and all elements are bonded together as illustrated in FIG. 7*c*. Application of adhesive layer 56 and bonding of all the elements together follows the same manner of bonding as described in the first method.

Figure 8A:
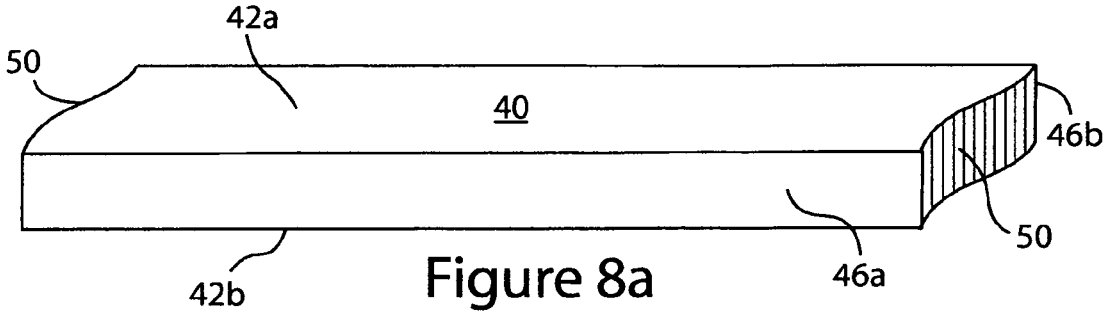
FIG. 8*a* is a first wood layer used in a fifth method of fabricating a board in accordance with the present invention.
Figure 8B:
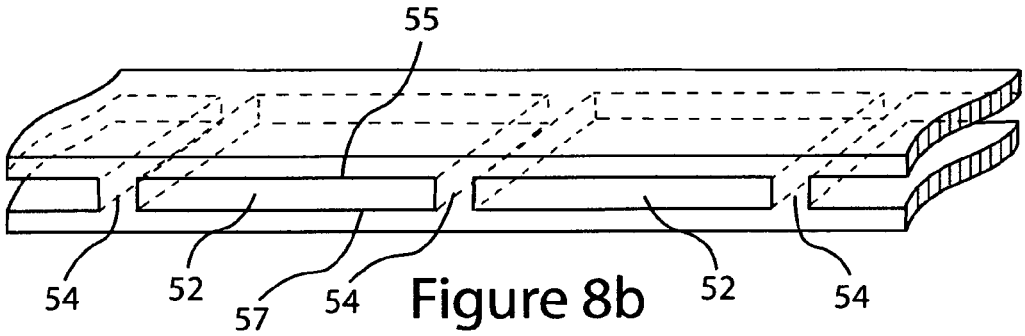
FIG. 8*b* is the first wood layer in FIG. 8*a* now milled from a lateral wood edge to create hollow regions and stiffening elements.
Figure 8C:
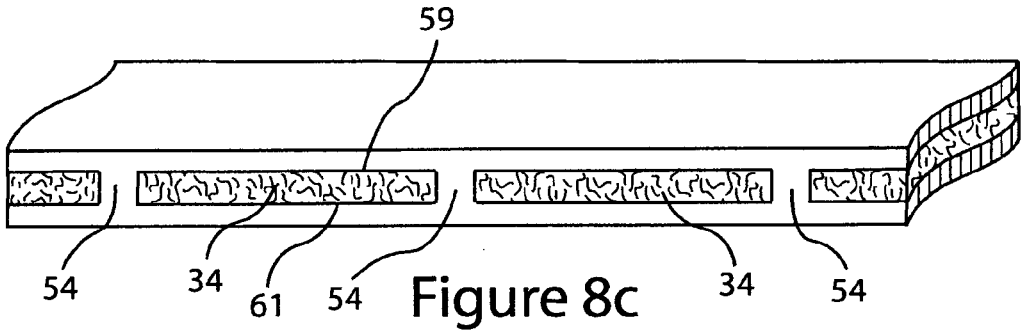
FIG. 8*c* is the first wood layer in FIG. 8*b* now having the hollow regions filled with sound attenuating elements.
Figure 8D:
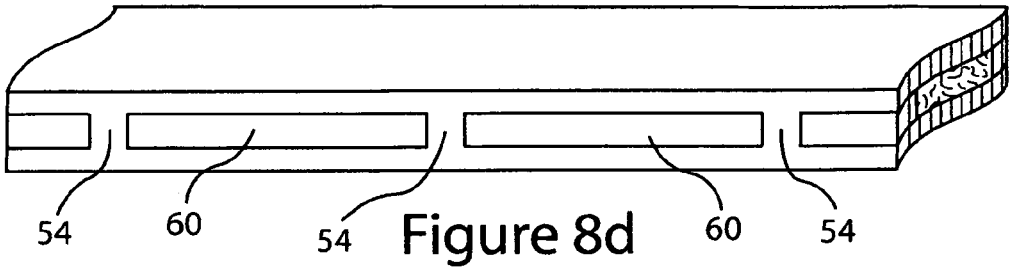
FIG. 8*d* is an alternative structure to that shown in FIG. 8*c* where in addition to sound attenuating element, lateral stiffening elements fill the hollow regions along the lateral edges of the wood structure.

FIGS. 8*a-d* illustrate a fifth method of fabricating board 20 according to the present invention. In this fifth method a first wood layer 40 is provided. First wood layer 40 can be a single piece of lumber, a piece of lumber having a soft wood side and a hardwood side, or a single piece of graded, finger-jointed lumber. A milling step occurs as in the first method, however, during the milling step first wood layer 40 is milled from either or both first wood lateral edge 46*a* or the second wood lateral edge 46*b* to provide hollow region 52 as shown in FIG. 8*b*. Milling first wood layer 40 in this manner creates transverse stiffening elements 54 that are an integral part of the first wood layer. Each hollow region 52 has a first hollow surface 55 and a second hollow surface 57. Hollow regions 52 can then be filled with precut sound attenuating elements 34 or filled with sound attenuating foam as illustrated in FIG. 8*c*. Each sound attenuating element 34 has a first side 59 and a second side 61. All first sides 59 of sound attenuating elements 34 are covered completely by first wood surface 42*a* of wood layer 40. All second sides 61 of sound attenuating elements 34 are covered completely by second wood surface 42*b* of wood layer 40. If it is desired to have wood on all surfaces of the finished board 20, lateral stiffening elements 60 made of wood may be incorporated into each hollow region 52 along first wood lateral edge 46*a* and second wood lateral edge 46*b* as illustrated in FIG. 8*d*.

Figure 9A:
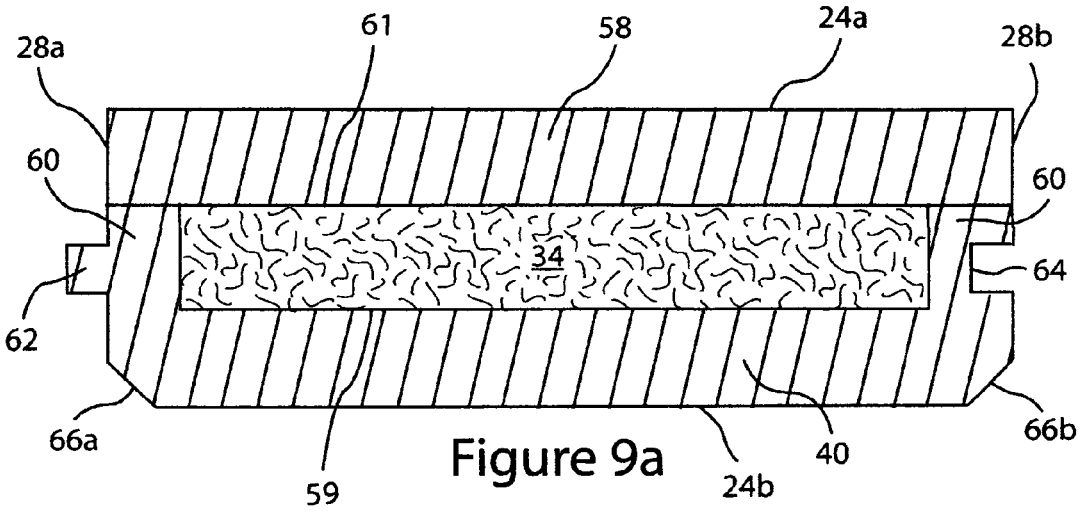
FIG. 9*a* is a transverse, sectional view through a wood board showing a first wood layer, a second wood layer, embedded sound attenuating element, lateral stiffening elements, and a single tongue and groove structure.
Figure 9B:
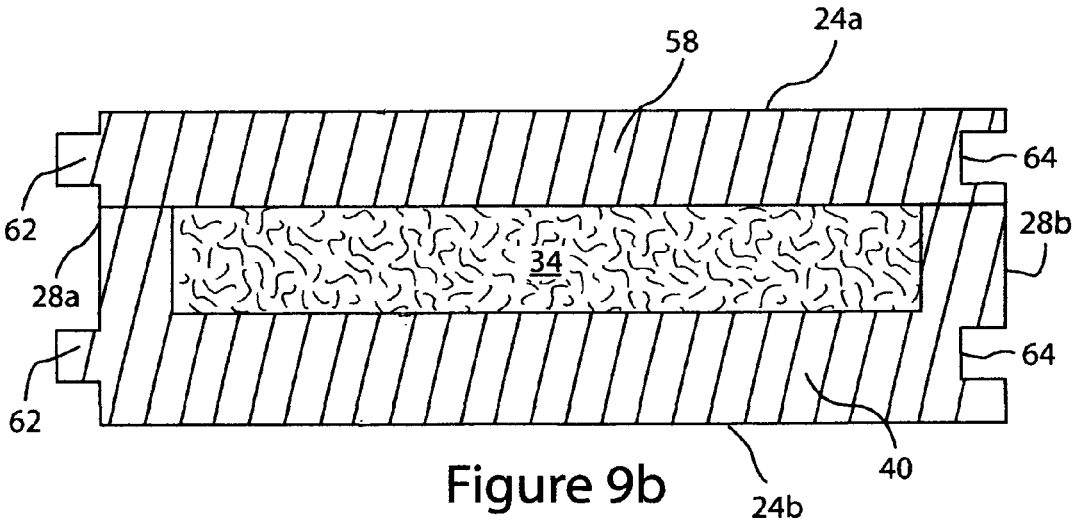
FIG. 9*b* is a transverse, sectional view through a wood board showing a first wood layer, a second wood layer, embedded sound attenuating element, lateral stiffening elements, and a double tongue and groove structure.

Once wood structures 22 have been formed using any of the methods described above, board 20 may be further shaped to provide a tongue 62 on first lateral edge 28*a* and a groove 64 on second lateral edge 28*b* of the board as illustrated in FIG. 9*a*. Alternatively, a double tongue and groove structure may be provided as shown in FIG. 9*b*. The tongue(s) 62 of a first board is shaped to fit in groove(s) 64 of a second board so that when boards 20 are laid adjacent to each other the tongue in groove structure provides a tight interlocking seam between the boards. The double tongue and groove structure can provide better interlocking between thick boards. Board 20 may also have a tongue on one end 30 and a groove on the other opposing end for creating a tongue in groove interlocking seam when the boards are laid end-to-end. Either the first surface 24*a* or second surface 24*b* may be further provided with first chamfer 66*a* and second chamfer 66*b* along first and second lateral edges, 28*a* and 28*b*, respectively. Chamfers 66*a* and 66*b* are typically ⅛-inch to ½-inch and help aesthetically offset any minor variations where boards 20 meet when the boards are laid adjacent to each other. A micro-bevel of less than 1/16-inch may also be provided to first lateral edge 24*a* and second edge 24*b* on the surface opposite the chamfered surface. Once shaped to spec board 20 may have either first surface 24*a* or second surface 24*b* sanded. A finishing layer 68 may be applied to either or both first surface 24*a* or second surface 24*b*. Finishing layer 68 protects the luster and beauty of the wood. Finishing layer 68 may include at least one from the group including a stain, polyurethane, varnish or a mixture thereof.

Figure 10:
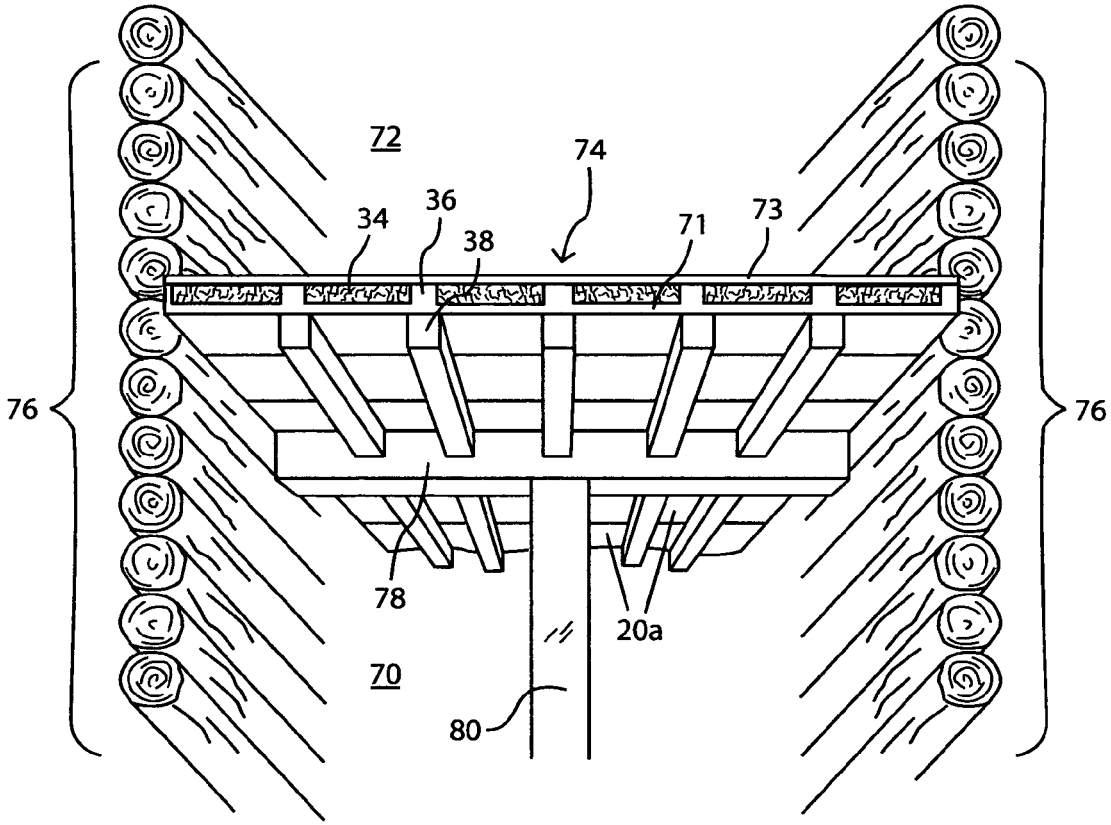
FIG. 10 is a perspective, sectional view of a hardwood-floor/softwood-ceiling structure according to the present invention illustrating a single set of adjacent boards comprising embedded sound attenuating elements and stiffening elements, the stiffening elements coincide with the location of floor joist to which the boards are secured.

When boards 20 have a softwood side 71 and hardwood side 73 they become boards 20*a* and are preferably used between a first level 70 and second level 72 of a building to provide a softwood-ceiling/hardwood-floor structure 74. Softwood-ceiling/hardwood-floor structure 74, illustrated in FIG. 10, is formed from a single set of adjacent boards 20*a*. When fabricating structure 74, carrying beams are first provided to span walls 76 between first level 70 and second level 72 within a building. First level 70 and second level 72 may be the basement and ground level, ground level and second story, second story and third story, etc. Carrying beams are usually softwood and match the wood used to construct the exterior walls of the home. Carrying beams include floor joists 38. If engineering calls for it, carrying beams may also include a main carrying beam 78. Floor joists 38 generally lay at right angles to main carrying beam 78. Main carrying beam 78 requires the support of post 80.

To construct the softwood-ceiling/hardwood-floor structure 74, the user usually starts on one side of the room. A first board 20*a* having embedded sound attenuating elements 34 and stiffening elements 36 is placed with softwood side facing downwards, toward floor joist 38 and secured to the floor joists. Each board 20*a* is secured by a securing element 39. For example, one may hammer nails through tongue 62 at the location of the stiffening element 36. The next board 20*a* is then laid adjacent to the first board with groove 64 of the second board fitted into tongue 62 of the first board. This second board 20*a* is then secured to floor joists 38. The process of laying and securing boards 20*a* adjacent to each other is carried out until the whole ceiling/floor structure 74 is complete. Using this process a hardwood-floor and softwood-ceiling structure 74 can be fabricated using only a single layer of boards 20*a* in one pass. This provides a significant time/cost savings over the three-step process of laying a softwood ceiling, laying a sound attenuating layer and then subsequently laying a hardwood floor. A softwood-ceiling/softwood-floor structure may also be fabricated in the manner described above by substituting boards having softwood on both sides with embedded sound attenuating elements 34 and stiffening elements 36. Similarly a hard-wood ceiling/hardwood-floor structure many be fabricated in the manner described above by substituting boards having hardwood on both sides with embedded sound attenuating elements 34 and stiffening elements 36.

Tongue 62 and groove 64 must be at the same height on each edge on board 20 so that they line up when the boards are placed adjacent and edge-to-edge with each other. Tongue 62 and groove 64 may span a considerable thickness of board 20 so as to include part of first layer 40 and second layer 58. Because first layer 40 and second layer 58 are thick layers, tongue 62 and groove 64 may lie within just one of either layer.

Boards 20 may also incorporate a veneer or laminate. Veneer consists of a thin layer of one type of wood bonded on top of a thick base board of a different type of wood, where the veneer is merely for changing the appearance of one side of the board. Veneer is usually a layer rotary peeled from a log and less than ⅛-inch thick. A veneer may be bonded to either side of board 20. A laminate is usually a layer less than 1/16-inch thick. A laminate may be bonded to either side of board 20.

When boards 20 have wood on all surfaces it may not be obvious where the location of stiffening elements are, therefore the boards may incorporate alignment markings 82 on the edges of board to show the location of the stiffening elements within the board. These alignment markings 82 may be a notch, ink mark or other type of mark to aid where one can cut board 20 and also where one can secure the board to the floor joist 38

The invention is not limited to the embodiments represented and described above but includes all variants notably those concerning the types of sound attenuating materials used, the shape and orientation of stiffening elements, the exact ratio of the thickness of the first wood layer to the second wood layer, the types of wood species making up the wood layers and the overall thickness of the bonded wood layers. Nothing in the above specification is intended to limit the invention more narrowly than the appended claims. The examples given are intended only to be illustrative rather than exclusive.

What is claimed is:

1. A combined ceiling and floor structure, comprising:

floor joists and a single set of adjacent boards; wherein said floor joists span between walls of a first room and a second room; wherein each adjacent board has a first surface, a second surface, a first lateral edge and a second lateral edge; wherein each adjacent board includes a softwood layer bonded to a hardwood layer; wherein said first surface is softwood and said second surface is hardwood; wherein said first lateral edge has a tongue; wherein said second lateral edge has a groove; wherein said first and second lateral edges have a chamfer on said first surface; wherein said softwood is laid towards said floor joists; wherein said adjacent boards are secured to said floor joist with said tongue in said groove; wherein each adjacent board has embedded sound attenuating elements; wherein each embedded sound attenuating element has a first side and a second side; wherein all first sides of said sound attenuating elements are covered completely by said first surface of softwood; wherein all second sides of said sound attenuating elements are covered completely by said second surface of hardwood; wherein each adjacent board has transverse stiffening elements embedded therein; wherein said transverse stiffening elements are milled to coincide with the location of said floor joist to which said board is secured; and wherein said sound attenuating elements are a continuous layer of sound attenuating material.

2. A structure as recited in claim 1, wherein the walls of the first room are softwood; wherein said first surface of softwood of said single set of adjacent hoards is the same species of wood as the softwood of the walls of the first room.

3. A structure as recited in claim 1, wherein each said adjacent board includes a microbevel on said first and second lateral edges; wherein said micro-bevel is on said second surface.

4. A board, comprising:

a) a piece of wood including a softwood layer directly bonded to a hardwood layer; said piece of wood having a first surface of softwood, a second surface of hardwood, a first lateral edge, a second lateral edge and opposing ends;

b) a tongue in said first lateral edge and a groove in said second lateral edge;

c) sound attenuating elements embedded within said piece of wood, each sound attenuating element having a first side and a second side, all first sides of said sound attenuating elements covered completely by said first surface of softwood, all second sides of said sound attenuating elements covered completely by said second surface of hardwood; and d) a plurality of transverse stiffening elements along the length of said piece of wood, said plurality of transverse stiffening elements milled within said piece of wood and located interior said piece of wood, said plurality of transverse stiffening elements are spaced along the length of said piece of wood at equal distances.

* * * * *